US005217310A

United States Patent [19]

Watanabe

[11] Patent Number: 5,217,310

[45] Date of Patent: Jun. 8, 1993

[54] PRINTING CONTROL METHOD

[75] Inventor: Atsushi Watanabe, Tokyo, Japan

[73] Assignee: Seikosha Co., Ltd., Tokyo, Japan

[21] Appl. No.: 690,451

[22] Filed: Apr. 24, 1991

[30] Foreign Application Priority Data

Apr. 24, 1990 [JP] Japan ..... 2-108069

[51] Int. Cl.[5] ..... B41J 2/30

[52] U.S. Cl. ..... 400/124; 400/121

[58] Field of Search ..... 400/124 TC, 124, 121; 346/76 PH; 101/93.05

[56] References Cited

U.S. PATENT DOCUMENTS

| | | | |
|---|---|---|---|
| 4,395,146 | 7/1983 | Arai | 346/76 PH |
| 4,447,819 | 5/1984 | Moriguchi et al. | 400/120 |
| 4,524,368 | 5/1985 | Inai et al. | 346/76 PH |
| 4,738,553 | 4/1988 | Uemura et al. | 400/124 TC |

FOREIGN PATENT DOCUMENTS

| | | | |
|---|---|---|---|
| 3812622 | 11/1988 | Fed. Rep. of Germany . | |
| 0004782 | 1/1982 | Japan | 400/124 TC |
| 0072870 | 5/1982 | Japan | 400/124 TC |
| 0038670 | 3/1984 | Japan | 400/124 TC |
| 0079765 | 5/1984 | Japan | 400/124 TC |
| 0162003 | 9/1984 | Japan | 400/124 TC |
| 0242856 | 9/1986 | Japan | 400/124 TC |
| 0249774 | 11/1986 | Japan | 400/124 TC |
| 0193843 | 8/1987 | Japan | 400/124 TC |
| 63-188059 | 8/1988 | Japan . | |

*Primary Examiner*—Edgar S. Burr
*Assistant Examiner*—John S. Hilten
*Attorney, Agent, or Firm*—Jordan and Hamburg

[57] ABSTRACT

A print head of a dot printer is controlled to move at a speed that is a function of a maximum dot duty cycle value from an accumulation of dot duty cycle values that are functions of the numbers of dots in the various columns of a line of print and a constant value.

11 Claims, 4 Drawing Sheets

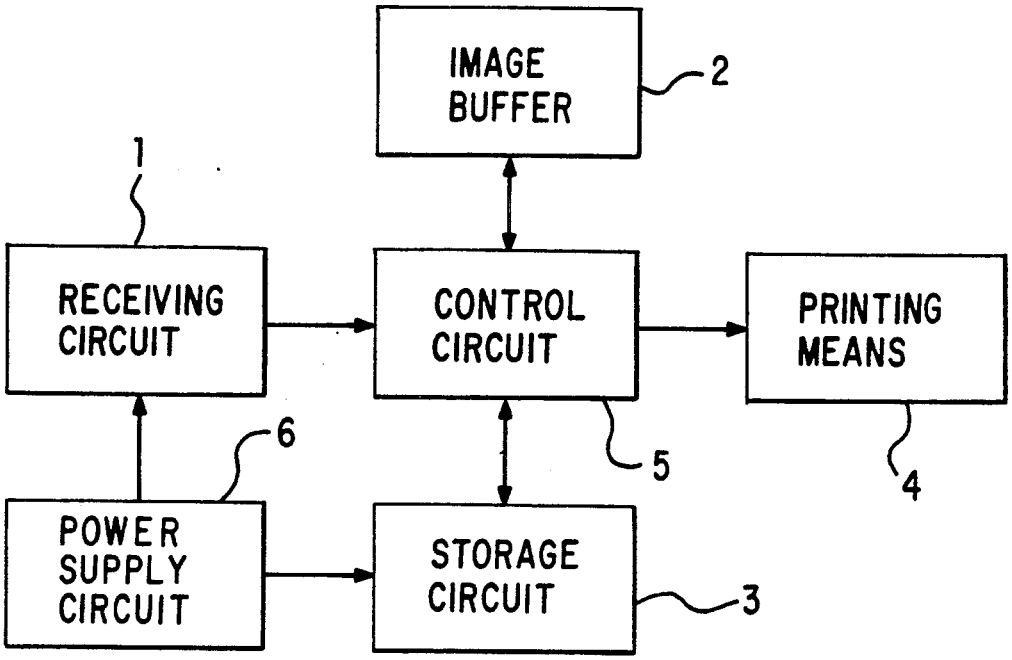
FIG. 1
| n | 0 | 1 | 2 | 3 | 4 | 5 | 6 | 7 | 8 | 9 | E |
|---|---|---|---|---|---|---|---|---|---|---|---|
| Xn | | 15 | 8 | 23 | 4 | 24 | 24 | 0 | 4 | 4 | 10 |
| Dn | | 3 | -4 | 11 | -8 | 12 | 12 | -12 | -8 | -8 | -2 |
| SUMn | 0 | 3 | 0 | 11 | 3 | 15 | 27 | 15 | 7 | 0 | 0 |
| SMAX | 0 | 3 | 3 | 11 | 11 | 15 | 27 | 27 | 27 | 27 | 27 |
FIG. 2(a)
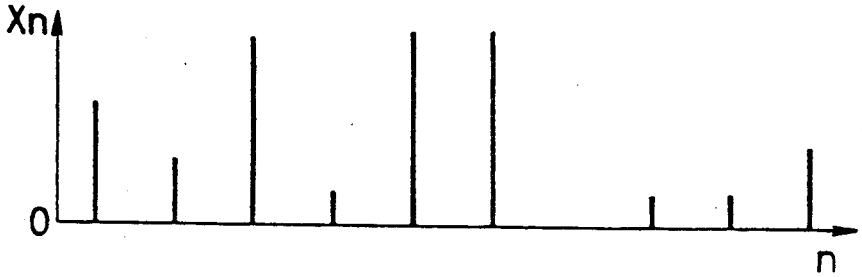
FIG. 2(b)

| SPEED | 1 | 2 | 3 | 4 | 5 |
|---|---|---|---|---|---|
| SPEED RATIO | 1 | 7/8 | 6/8 | 5/8 | 4/8 |
| MAXIMUM DUDY VALUE AT THE SPEED | a1 | a2 | a3 | a4 | |

PRINTING CONTROL METHOD

FIELD OF THE INVENTION

The present invention relates to a printing control method.

BACKGROUND OF THE INVENTION

A method for controlling a printing control system for controlling scanning of printing means in accordance with the print dot duty in a dot printer is described in Japanese Patent Application Laid-Open No. SH063-188059. In this method, the number of dots to be printed in every dot column in one line is counted, a weight is given in accordance with the counted number of dots, numeric values determined by the weights are accumulated successively and, when the accumulated value exceeds a reference value, that is, when a print dot duty value in one line exceeds the reference value, printing of that line is performed by separating the printing into a plurality of line printing scans.

In the above-described conventional printing control system, divided printing is performed when the print dot duty value exceeds a reference value in response to a decision in the operation of the printing control. The number of divisions in divided printing is fixed. In divided printing, the line is printed with three reciprocating scannings by dividing the number of print dots in the line by 3 when it is difficult to print one column with one reciprocating scanning of the printing means. In the above-mentioned conventional system, however, since the state of print dot duty values is not detected for dot columns after the dot column in which divided printing has been determined, a reduction in the print quality of dot columns after the dot row in which the above-described divided printing has been determined sometimes occurs, depending on setting of the number of reciprocation times in divided printing. Further, printing may be performed without causing any reduction in the print quality if a large number of division times is set during divided printing, but useless printing time is spent in many cases with this arrangement.

SUMMARY OF THE INVENTION

It is an object of the present invention to provide a printing control method which can control the scanning of a printing means with the best drive efficiency without damaging the print quality in accordance with print dot duty values in respective lines.

According to the present invention, the above-described problems are solved by a printing control method wherein, in a dot printer printing of a font or a graphic and the like by driving printing elements selectively while scanning in a line direction, with printing means having K printing elements disposed in parallel in a column direction. In this method, print dot duty values are computed sequentially starting from a first column in the printing direction based on the number of dots to be printed in each dot line within a printing range in the line. These respective duty values are accumulated consecutively, and scanning of the printing means is controlled as a function of the peak value of the accumulated values, thereby to print the line. Further, in the printing control method of the invention, the print dot duty value is computed with a difference value between the number of print dots in one dot column and a predetermined numeric value k ($K \geqq k$), the scanning speed of the printing means is changed in accordance with the peak value. The number of times the line is scanned in the printing of the line may also be changed in accordance with the peak number, thus solving the above-described problems.

First, the basic concept of the present invention will be described. For example, assume that power supply capacity is capable of driving 12 pins at a time in a 24-pin printer. Assume also that the power supply voltage is 24 V. If printing 24 dots in one dot column continues for t dot columns, a portion of the columns can be printed at a voltage that is 10% less than the power supply voltage (assuming that compensation is made for a reduction of up to 10% of the power supply voltage) as shown in FIG. 6 by the energy stored in a capacitor on the secondary side of the power supply transformer, but the power supply voltage drops by more than 10% when printing is continued in such a state. When printing is sustained at a point B in FIG. 6, the power supply voltage is returned to 24 V at a point C. Accordingly, if the quantity of energy discharged from the capacitor between points A and B in the figure and the quantity of energy charged in the capacitor between points B and C can be computed in advance on the basis of dot data of dot columns, it is possible to use the power supply capacity without any loss.

As described above, the capacitor discharges when 13 pins or more are driven at a time, and is charged when 11 pins or less are driven. Assuming that the energy consumption when one pin is driven is constant, the capacitor has been charged completely when printing is started, and the number of pins which are driven at a time is X, (X-12) pins worth of energy is discharged from the above-mentioned capacitor when 13 pins and more are driven at a time, and (12-X) pins worth of energy is charged in the capacitor when driving 11 pins or less. Further, when 12 pins are driven at a time, the output current from the power supply is equal to the current consumed by 12 pins. Thus, it may be considered that the energy stored in the capacitor does not change.

It is possible to compute the maximum output energy in one line by accumulating the output energy in each dot column. It is determined whether the power supply voltage drop with this maximum output energy is, or is not, within 10%, and scanning of the printing means is controlled in accordance with this determination.

BRIEF DESCRIPTION OF THE DRAWINGS

An embodiment of the present invention will be described hereafter with reference to the drawings wherein:

FIG. 1 is a block diagram of one embodiment of the invention;

FIG. 2(A) is an explanatory diagram for explaining the detecting operation of the maximum print dot duty value in a line of print;

FIG. 2(B) further explains the detecting operation of the maximum print dot duty value in a line of print;

DESCRIPTION OF THE PREFERRED EMBODIMENTS

Figure 3:
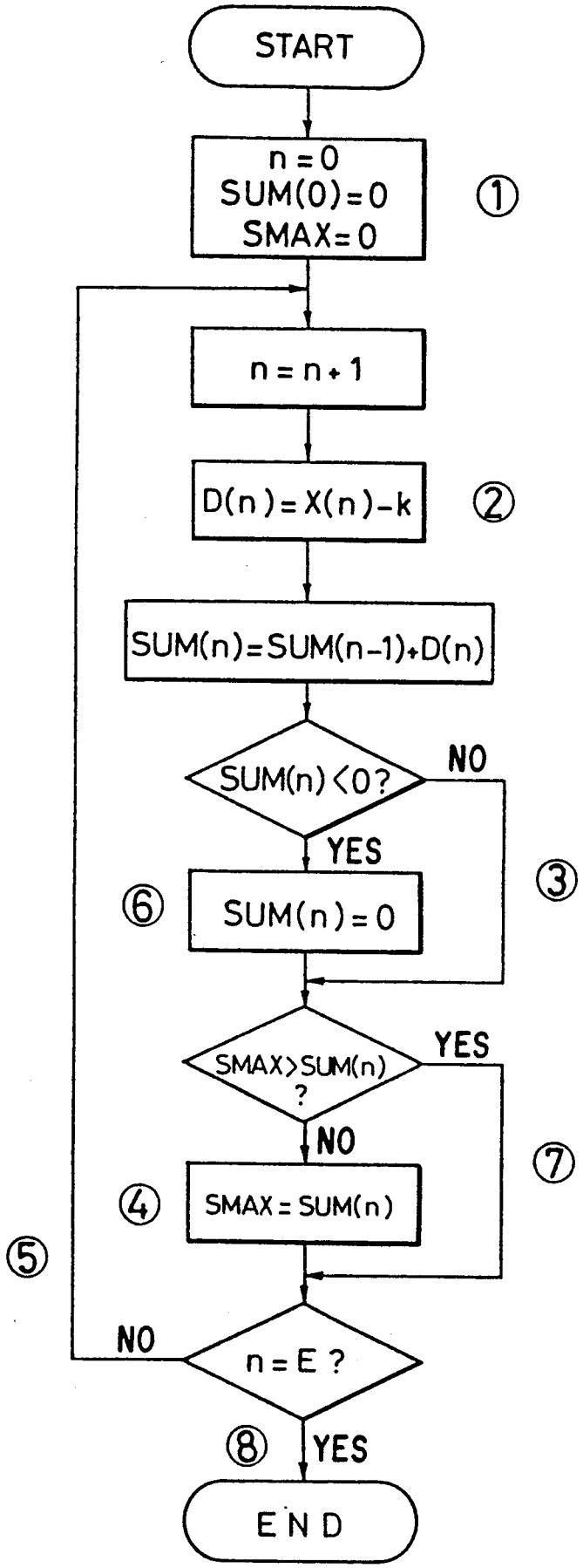
FIG. 3 is a flow chart for explaining the detecting operation of the maximum print dot duty value in the line.

In FIG. 1, numeral 1 denotes a receiving circuit for receiving printing data, printing instruction and the like from a host computer (not shown). Image buffer 2 temporarily stores printing data received by the receiving circuit 1. A storage circuit 3 has values al to a4 of the maximum print dot duty value in one line for determining the printing speed. A printing means 4 is comprised of a carriage motor and a print head or the like. A control circuit 5 controls the operation of the whole printer, such as printing operations, computations of print dot duty values and the like. The power supply circuit 6 is a commercial power supply, including a transformer, a rectifier, and a capacitor for compensating instantaneous power supply voltage drop, and the like.

Assume, for example, that the number of print dots Xn in respective dot columns in the line is as shown in FIG. 2(*b*). In FIG. 2(*a*), n represents a dot column number in the line, Xn represents the number of print dots in the nth dot column, and Dn represents the print dot duty values in the nth do column, which are computed by subtracting a comparison coefficient k described later from the number of print dots Xn. SUMn represents the sum of respective print dot duty values up to the nth dot line, and SMAX represents the maximum print dot duty value u to the nth dot column.

The detecting operation of the above-mentioned maximum print dot duty value in the line will now be described with reference to the flow chart shown in FIG. 3. In the present embodiment, the maximum number of print dots in a dot column with the printing means 4 is 24 pins and the power supply capacity is capable of simultaneous driving of 12 pins for example. Then, this numeric value 12 is set as the comparison coefficient k. First, n, SUMn and SMAX are reset to "0" by the control circuit 5 (step ①).

Next, the print dot duty value in the first dot column is detected, assuming $n=1$. Since 15 dots are printed in the first dot column, $Xn=15$ is obtained, and $Dn=Xn-k=15-12=3$ is computed (step ②).

Next, $SUMn=SUM\ (n-1)+Dn=3$ is computed, and it is determined whether this value is smaller than "0" or not. Since $SUMn \geqq 0$ here, this value is stored as $SUMn=3$ (Step ③).

Next, SMAX and SUMn are compared with each other, and the larger value is stored as SMAX. Now, since $SMAX=0$ and $SUMn=3$, $SMAX<SUMn$, and $SMAX=3$ is stored (step ④).

The print dot duty value is now detected in a manner similar to that described above with respect to the second dot row, assuming $n=2$ (step ⑤).

As seen in FIG. 2(*a*), 8 dots are printed in the second dot column. Thus, $Xn=8$ is obtained, and $Dn=8-12=-4$ is computed (step ②).

Then, $SUMn=SUM(n-1)+Dn=3-4=-1$ is computed. $SUMn=0$ is always stored when $SUMn<0$ (step ⑥).

Then, $SUMn=0$ and $SMAX=3$ are compared with each other. Since $SMAX>SUMn$, $SMAX=3$ is stored (Step ⑦). Namely, it is determined that the maximum print dot duty value up to the second dot column is "3".

Similar operations are repeated up to the Eth dot column, thus completing the detecting operation of the maximum print dot duty value in the line (step ⑧).

It is now determined that the maximum print dot duty value in the line in the present example is "27" as shown in FIG. 2.

Figures 4, 5:
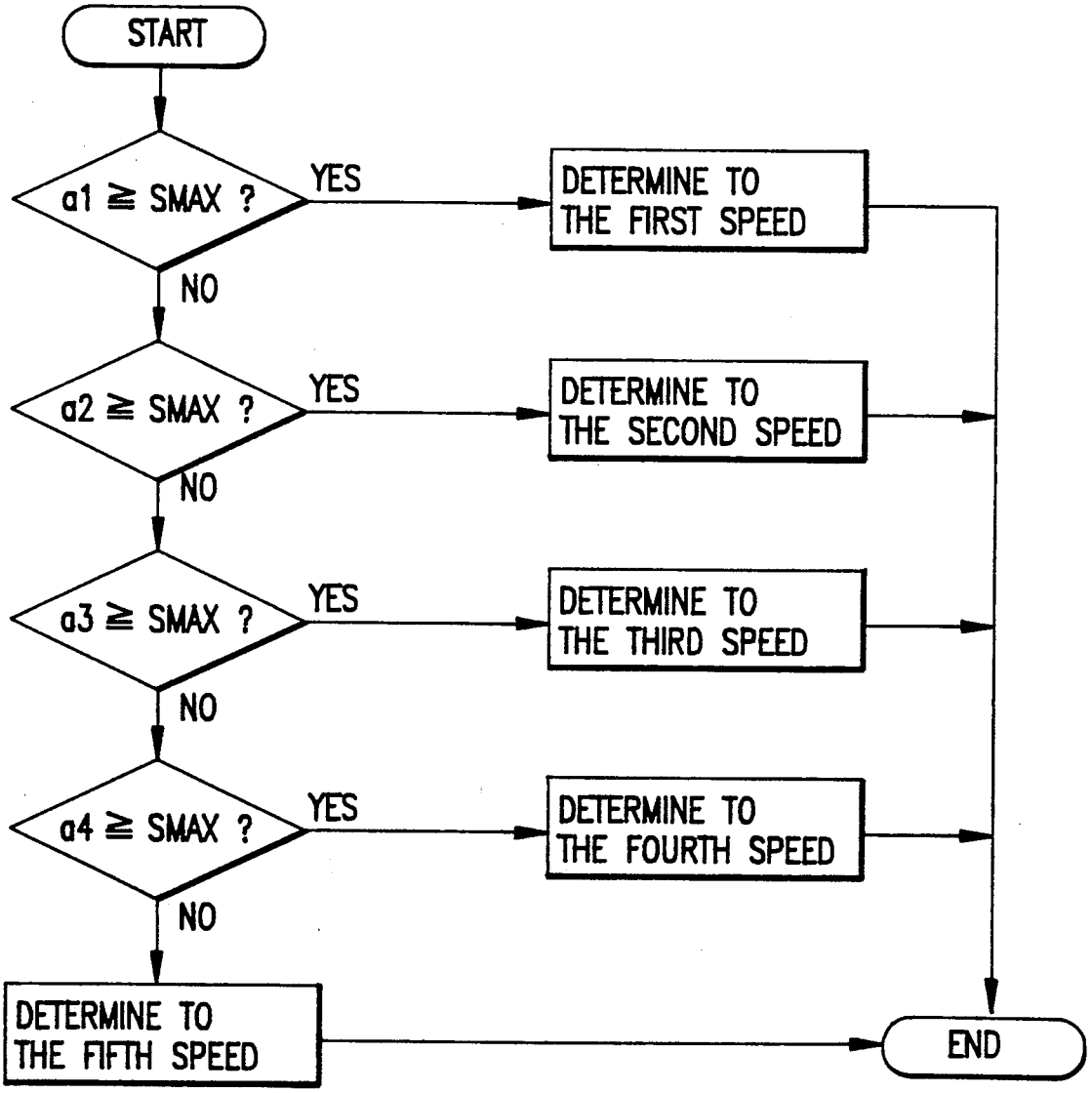
FIG. 4 is an explanatory chart showing an example of a relationship between the maximum print dot duty value in the line and the scanning speed of the print head.
FIG. 5 is a flow chart for explaining the operation of determining the scanning speed of the print head.
Figure 6:
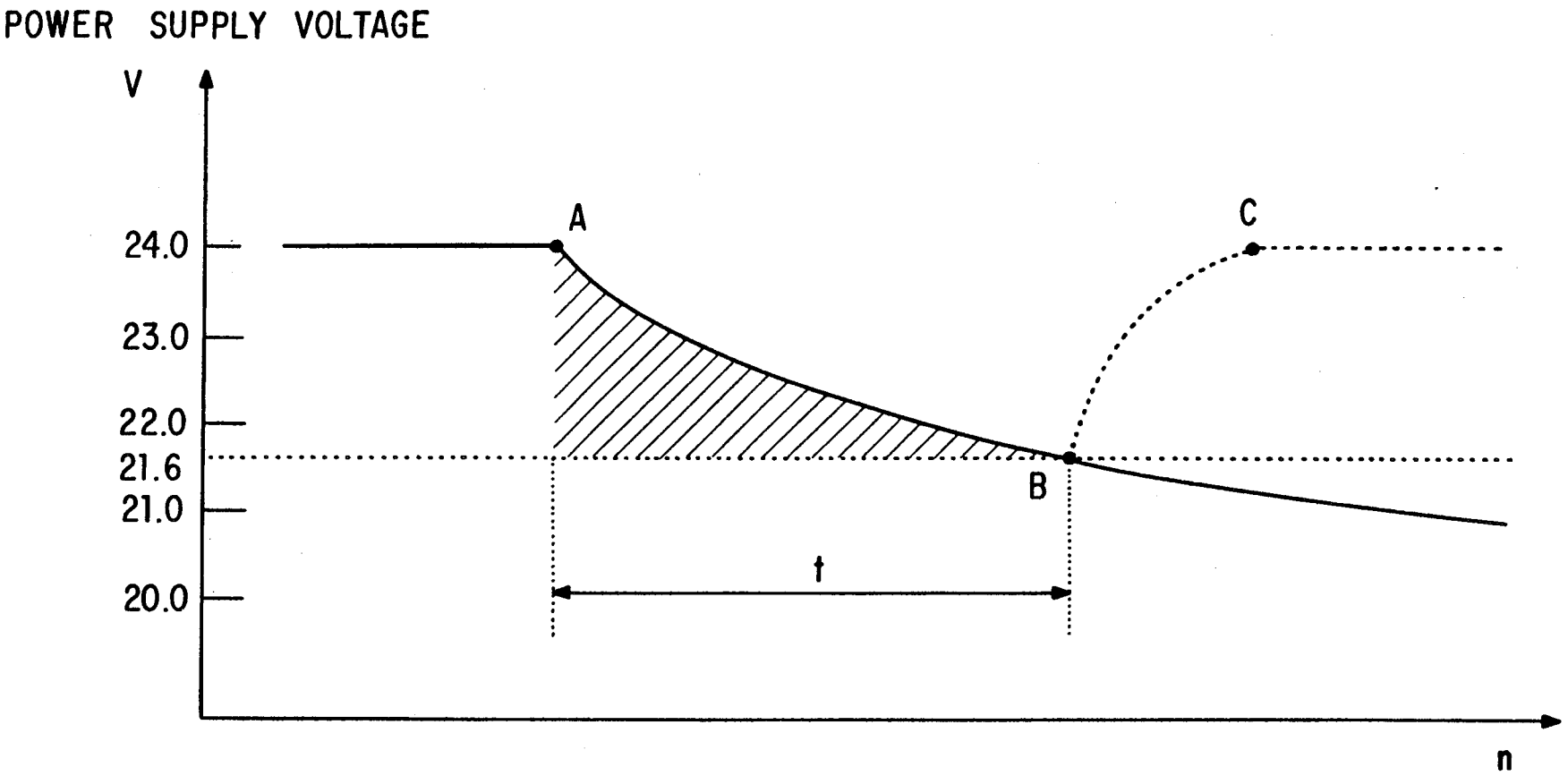
FIG. 6 is a graph showing a concrete example of power supply voltage variation at the time of printing.

The scanning speed of the print head is now determined by the control circuit 5 as a function of the maximum print dot duty value detected in the above-described operation. FIG. 4 shows the relationship between the maximum print dot duty value in the line and the scanning speed in accordance with one embodiment of the invention.

The printing speed determining operation will be described with reference to a flow chart shown in FIG. 3.

When SMAX in the line is determined in the above-described print dot duty value detecting operation, a threshold value al is read first from the storage circuit 3 and is compared with SMAX by the control circuit 5. When the threshold value $a1 \geqq SMAX$, the scanning speed of the print head is selected to be a first speed.

If, however, the threshold value a1 is not $a1 \geqq SMAX$, then SMAX and the threshold value a2 are compared with each other. When $a2 \geqq SMAX$, the scanning speed of the print head is selected to be a second speed. The second speed is $\frac{7}{8}$ of the first speed.

On the other hand, if the threshold value a2 is not $a2 \geqq SMAX$, then SMAX and a threshold value a3 are compared with each other. When the threshold value $a3 \geqq SMAX$, the scanning speed of the print head is selected to be a third speed. The third speed is 6/8 of the first speed.

On the other hand, if the threshold value a3 is not $a3 \geqq SMAX$, then SMAX and a threshold value a4 are compared with each other. When $a4 \geqq SMAX$, the scanning speed of the print head is selected to be a fourth speed. The fourth speed is $\frac{5}{8}$ of the first speed.

On the other hand, if the threshold value a4 is not a4 SMAX, the scanning speed of the print head is selected to be a fifth speed. The fifth speed is 4/8 of the first speed.

In this manner, the scanning speed of the print head is selected as a function of the maximum print dot duty value SMAX in the line.

When the above-mentioned respective threshold values are set in advance to be, for example $a1=12$, $a2=15$, $a3=18$ and $a4=21$, the fifth speed is selected in the embodiment shown in FIG. 2.

In the above-described embodiment, the ratio of scanning speeds of the print head and the maximum print dot duty values corresponding to respective scanning speeds have been set as shown in FIG. 4, they are not limited thereto, however, and any type number and value may be employed.

Also, in the above-described embodiment, the scanning speed of the print head is changed on the basis of the maximum print dot duty value in the line. However, it may also be arranged that the number of times the line is scanned in a printing operation is also changed as a function of the peak value.

According to the present invention, the maximum print dot duty value in the line is obtained as a function of the number of print dots in respective print dot columns, and the scanning of the print head in printing the line is controlled as a function thereof. Accordingly, it is possible to always print at an optimum scanning speed, making the greatest use of the power supply capacity without deteriorating the print quality.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A printing control method for a dot printer having a line direction including a plurality of lines parallel to said line direction and a column direction including a plurality of sequential columns parallel to the column direction and a printing direction, comprising:

printing a font or graphic and the like by driving printing elements selectively while scanning in the line direction, the printer having a plurality of printing elements disposed in parallel in the column direction;

computing print dot duty values in each of said dot columns within a printing range of one of said lines by determining a difference between a number of dots to be printed in each of said dot columns and a predetermined numeric value $k(K \geqq K)$, wherein K is a number of printing elements and both K and k are integers, modifying said dot duty value to be the sum of said dot duty value and the dot duty value that was modified in the previous one of said columns;

accumulating these respective duty values consecutively; and controlling scanning speed of said printer in accordance with a peak value of the accumulated values thereby to print said line.

2. A printing control method according to claim 1, wherein the dot printer has a scanning direction comprising changing the scanning speed of said dot printer in accordance with the peak value in the line.

3. A printing control method according to claim 1, comprising scanning the line a number of times and changing the number of times the line is scanned in the printing of said line in accordance with the peak value.

4. A method for controlling a dot printer in the printing of a line of print wherein a print head is moved in a given line direction, the line having a plurality of sequential columns and the columns of the line having a plurality K of dot positions, wherein K is an integer, said method comprising:

determining the umber of dots to be printed in each of said columns of the line, determining a difference between said number of dots in each of said columns and a predetermined integer coefficient, determining a dot duty value from a sum of said difference for each of said columns and a dot duty value for a previous one of said columns of the line, selecting a scanning speed for the print head as a function of a maximum dot duty value determined for said column of the line, and moving said print head at said speed.

5. The method of claim 4 wherein said step of determining a difference comprises determining the difference between said number of dots and K.

6. The method of claim 4 comprising resetting said dot duty value prior to determining said dot duty value for the first column of said line.

7. The method of claim 4, wherein said step of selecting comprises selecting said speed as a function of the maximum dot duty value of said line.

8. The method of claim 4, wherein said step of selecting comprises selecting a value from a sequence of predetermined values, said predetermined values corresponding to different speeds of said print head.

9. In an apparatus for controlling a dot printer in printing a line of print, comprising means for receiving print signals, and control means for receiving said signals and controlling a print head to move in a given line direction, the line having a plurality of sequential columns and the columns of the line having a plurality K of dot positions, wherein K is an integer, the improvement wherein said apparatus comprises means for determining a number of dots to be printed in each of said columns of the line, means for determining a difference between said number of dots in each of said columns and a predetermined integer coefficient, means for adding said difference for each of said columns and a dot duty value for a previous one of said columns of the line for providing a dot duty value for each of said columns, and means for selecting a scanning speed for the print head as a function of a maximum dot duty value determined for said columns of the line.

10. A method for controlling a dot printer in printing a line of print wherein a print head is moved in a given line direction, the line having a plurality of sequential columns and the columns of the line having a plurality K of dot positions, wherein K is an integer, said method comprising:

determining a number of dots to be printed in each column of the line, determining a difference between said number of dots in each column and a predetermined integer coefficient, determining a dot duty value from a sum of said difference for the respective column and a dot duty value for a previous column of the line, selecting a number of times for scanning the line as a function of a maximum dot duty value in a column of the line, and moving said print head to scan said line said number of times.

11. In an apparatus for controlling a dot printer in printing a line of print, comprising means for receiving print signals, and control means for receiving said signals and controlling a print head to move in a given line direction, the line having a plurality of sequential columns and the columns of the line having a plurality K of dot positions, wherein K is an integer, the improvement wherein said apparatus comprises means for determining a number of dots to be printed in each column of the line, means for determining a difference between said number of dots in each column and a predetermined integer coefficient, means for adding said difference for each column and a dot duty value for a previous column of the line for providing a dot duty value for a respective column, and means for controlling a number of times the print head scans as a function of a maximum dot duty value in a column of the line.

* * * * *